US006305962B1

(12) United States Patent
Maher et al.

(10) Patent No.: US 6,305,962 B1
(45) Date of Patent: Oct. 23, 2001

(54) INLINE CABLE CONNECTOR

(75) Inventors: Timothy R. Maher, Orangevale; Thomas C. Rintoul, Gold River, both of CA (US)

(73) Assignee: Nimbus, Incorporated, Rancho Cordova, CA (US)

( * ) Notice: Subject to any disclaimer, the term of this patent is extended or adjusted under 35 U.S.C. 154(b) by 0 days.

(21) Appl. No.: 09/250,130

(22) Filed: Feb. 16, 1999

(51) Int. Cl.[7] ..... H01R 13/28
(52) U.S. Cl. ..... 439/287; 439/451; 439/27
(58) Field of Search ..... 439/287, 587, 439/294, 588, 427, 521, 367, 369

(56) References Cited

U.S. PATENT DOCUMENTS

| | | | | |
|---|---|---|---|---|
| 1,975,244 | * | 7/1932 | Wiseman | 439/287 |
| 2,825,039 | * | 2/1958 | Schurman et al. | 439/287 |
| 3,030,601 | * | 4/1962 | Krebs | 439/369 |
| 3,487,353 | * | 12/1969 | Massa | 439/936 |
| 3,551,879 | * | 12/1970 | Waller | 439/371 |
| 3,953,099 | * | 4/1976 | Wilson | 439/556 |
| 4,030,792 | | 6/1977 | Fuerst . | |
| 4,114,970 | * | 9/1978 | Hall, Jr. | 439/294 |
| 4,179,179 | * | 12/1979 | Lowden | 439/559 |
| 4,195,894 | * | 1/1980 | Kotski | 439/101 |
| 4,204,188 | | 5/1998 | Weichart et al. . | |
| 4,211,461 | * | 7/1980 | Wescott | 439/357 |
| 4,398,781 | * | 12/1990 | Dan | 439/287 |
| 4,446,229 | | 5/1984 | Indech | 435/1 |
| 4,500,980 | | 2/1985 | Copeland . | |
| 4,526,430 | * | 7/1985 | Williams | 439/287 |
| 4,627,836 | | 12/1986 | MacGregor | 604/93 |
| 4,696,532 | | 9/1987 | Mattis . | |
| 4,789,351 | | 12/1988 | Fisher, Jr. et al. . | |
| 4,869,683 | * | 9/1989 | Nelson | 439/371 |
| 4,944,722 | | 7/1990 | Carriker et al. | 600/16 |
| 4,976,634 | * | 12/1990 | Green et al. | 439/936 |
| 5,211,546 | | 5/1993 | Isaacson et al. | 417/356 |
| 5,433,632 | | 7/1995 | Cherney et al. | 439/495 |

(List continued on next page.)

FOREIGN PATENT DOCUMENTS

| | | | | |
|---|---|---|---|---|
| 632052 | * | 11/1949 | (GB) | 439/294 |
| 240113 | * | 8/1980 | (GB) | 439/367 |

OTHER PUBLICATIONS

Parnis et al.; "Progress in the Development of a Transcutaneously Powered Axial Flow Blood Pump Ventricular Assist System"; ASAIO J 43(5); Sep. 1997; pp. M576–M580.

MacGregor et al.; "The Porous–surfaced electrode"; The Journal of Thoracic and Cardiovascular Surgery 78(2); Aug. 1979; pp. 281–291.

MacGregor et al.; "Improved Thromboresistance of Mechanical Heart Valves with Endothelialization of Porous Metal Surfaces"; Surgical Forum 30; 1979; pp. 239–241.

Bobyn et al.; "Effect of pore size on the peel strength of attachment of fibrous tissue to porous–surfaced implants"; Journal of Biomedical Materials Research 16(5); Sep. 1982; pp. 571–584.

*Primary Examiner*—Renee Luebke
*Assistant Examiner*—Briggitte R. Hammond
(74) *Attorney, Agent, or Firm*—Fish & Richardson P.C., P.A.

(57) ABSTRACT

An inline electrical connector includes a first housing shell and a second housing shell. The first housing shell has a cable entrance section and a planar mating section that includes a plurality of electrical connectors. The second housing shell also has a cable entrance section and a planar mating section that has a plurality of electrical connectors. The second housing shell can be mated with the first housing shell by overlapping engagement of the planar mating sections. The electrical connectors on the first housing shell are configured to mate with the electrical connectors on the second housing shell when the second housing shell is mated with the first housing shell.

55 Claims, 15 Drawing Sheets

U.S. PATENT DOCUMENTS

| | | | | |
|---|---|---|---|---|
| 5,447,453 | | 9/1995 | Smith et al. . | |
| 5,486,123 | * | 1/1996 | Miyazaki | 439/825 |
| 5,618,206 | | 4/1997 | Sawada et al. . | |
| 5,632,779 | | 5/1997 | Davidson | 623/12 |
| 5,664,953 | | 9/1997 | Reylek | 439/111 |
| 5,713,954 | | 2/1998 | Rosenberg et al. . | |
| 5,741,148 | | 4/1998 | Biernath | 439/284 |

* cited by examiner

INLINE CABLE CONNECTOR

TECHNICAL FIELD

The present invention relates to an electrical connector and, more particularly, to an inline electrical connector useful in space-confined conditions.

BACKGROUND INFORMATION

Inline electrical connectors are used to connect two cables containing multiple wires. They are used in numerous applications that vary from blood pump systems to airplane cockpits to data transmission lines. In many of the applications, the connector must fit within a space-limited area. In an airplane cockpit, for example, the inline electrical connector may connect a cable carrying signals from numerous instruments to a cable connected to display gauges and may be required to fit within a space already crowded with wires, cables, and connectors.

In other applications, the connector may be subject to harsh environmental and use factors such as fluids, bends, compressive forces, rotational forces, and stress forces. One application in which the connector may be subject to harsh environmental and use factors is in oil well drilling where a connector may be used to connect a cable from a measuring or sensing device deep in a narrow oil well shaft to a cable from display gauges at the well surface.

Connectors also may be used in applications where failure of the connector is catastrophic, such as in blood pumps and airplane controls. Implantable blood pumps present challenges to connectors. A number of implantable blood pumps presently are under development for application as either artificial hearts or cardiac assist devices. An axial-flow blood pump, for example, typically includes a pump housing that defines a blood flow channel, an impeller mechanism mounted within the blood flow channel, an electric motor rotor coupled to actuate the impeller mechanism for blood pumping action, and an electric motor stator for actuating the rotor by electromagnetic force.

The energy delivered to drive the rotor is carried in an electrical cable connected to a controller/power module. The controller/power module may be implanted in the abdomen or may remain outside the body, in which case the electrical cable passes through a percutaneous port in the skin. The electrical cable has an inline electrical connector to permit the exchange of controller/power modules.

The connector is subject to harsh environmental and use factors and a limitation of space. For example, the connector may be subject to bodily fluids, bending forces, stresses, and strains, all of which challenge the integrity of the connector. Failure of the connector due to any one of these challenges is catastrophic to the patient dependent on the blood pump for cardiac support. Therefore, the design and construction of the connector must be robust enough to withstand these challenges.

SUMMARY

In one general aspect, an inline electrical connector includes a first housing shell and a second housing shell. The first housing shell has a first cable entrance and a substantially planar first mating section that includes a first plurality of electrical connectors. The second housing shell has a second cable entrance section and a substantially planar second mating section that includes a second plurality of electrical connectors. The second housing shell is configured to mate with the first housing shell with an overlapping engagement of the first mating section and the second mating section. The first and second connectors are oriented to extend substantially perpendicular to the first and second mating sections. The second electrical connectors are configured to mate with the first electrical connectors upon overlapping engagement of the first and second mating sections. The mated shells may define a substantially cylindrical connector assembly.

Embodiments may include one or more of the following features. For example, the inline electrical connector may further comprise an outer shell configured to be placed around the mated first and second housing shells to prevent the separation of the mated first and second housing shells. The first housing shell also may include a first fluid barrier section and the second housing shell may include a second fluid barrier section. Each one of the housing shells may include a snap ring and at least one o-ring associated with each of the fluid barrier sections. The snap rings and o-rings are configured to form an interference fit with a portion of the outer shell. The outer shell may include a pair of channels on its inside surface configured to receive and form an interference fit with the snap rings. At least a portion of the inner diameter of the outer shell may be configured to form an interference fit with the o-rings of the first housing shell and second housing shell to prevent fluid from passing between the o-rings and the outer shell.

The first mating section and the second mating section may have a semicircular shape. The first mating section may include a pair of interlocking fingers and the second mating section may include a pair of notched regions configured to receive the pair of interlocking fingers.

The inline electrical connector also may include a first electrical cable positioned in the cable entrance of the first housing shell and a second electrical cable positioned in the cable entrance section of the second housing shell. A first outer tube may surround the first electrical cable and cable entrance of the first housing shell and a second outer tube may surround the second electrical cable and cable entrance of the second housing shell. The tubes can be crimped, molded, or otherwise constructed to secure the cable and provide bend relief.

The electrical connector may include a first chamber adjacent to the first cable entrance, a lip between the first chamber and the first cable entrance, and a ball disposed within the chamber. The diameter of the ball may be larger than the diameter of the lip. The first electrical cable may include a plurality of conducting wires that pass around the outer surface of the ball. The ball also may include a channel and the first electrical cable also may include a fiber, and the fiber may pass through the channel. The ball forms part of a cable strain relief mechanism.

The first electrical connectors may be oriented to extend in a direction substantially perpendicular to the first mating section and the second electrical connectors may be oriented to extend in a direction substantially perpendicular to the second mating section. The first electrical connectors may comprise conductive sockets and the plurality of second electrical connectors may comprise conductive pins configured to be placed in the conductive sockets. Alternatively, the first electrical connectors may comprise pairs of spring-biased conductive blades and the second electrical connectors may comprise conductive blades configured to be placed between the spring-biased conductive blades.

The inline electrical connector also may include a plurality of lips surrounding at least a portion of each one of the first electrical connectors and a plurality of grooves surrounding at least a portion of each one of the second electrical connectors. Each groove is configured to receive one lip to form an interference fit connection. The interference fit may be fluid resistant and resist axial and lateral separation of the first planar connector surface from the second planar connector surface.

In another general aspect, the inline electrical connector may be incorporated in a cardiac assist device system. Such a system may include a cardiac assist device, a controller, an outer shell, a first electrical cable, and a second electrical cable. The first electrical cable is connected to the cardiac assist device at a first end and to a first connector structure at a second end. The second electrical cable is connected to the controller at a first end and a second connector structure at a second end.

The first connector structure defines a first substantially planar connector surface in which a plurality of first electrical connectors are disposed and extend in a direction substantially perpendicular to the first substantially planar surface. The second connector structure defines a second substantially planar connector surface in which a plurality of second electrical connectors are disposed and extend in a direction substantially perpendicular to the second substantially planar surface.

Embodiments may include one of more of the following features. For example, the second electrical connectors may be oriented to receive the first electrical connectors upon overlapping engagement of the first connector structure and the second connector structure. The first connector structure may include a first snap ring, at least one o-ring, and a pair of notched regions and the second connector structure may include a second snap ring, at least one o-ring, and a pair of interlocking fingers configured to be inserted into the pair of notched regions. The outer shell may include a pair of channels encircling an inside circumference of the outer shell configured to retain the first and second snap rings. The outer shell may be configured to be placed around the mated connector structures and an interference fit may be formed between the o-rings and at least a portion of an inside circumference of the outer shell.

In another general aspect, a method of forming an inline electrical connection includes inserting a plurality of pins disposed in a plurality of channels on a substantially planar first mating surface of a first connector structure into a plurality of sockets disposed in a plurality of channels on a substantially planar second mating surface of a second connector structure upon overlapping engagement of the first mating section and the second mating section.

Embodiments may include one or more of the following features. For example, the method may further include inserting a pair of interlocking fingers of the first connector structure into a pair of notched regions of the second connector structure upon mating of the first connector structure and the second connector structure. The method also may include inserting a plurality of lips on the first mating section into a plurality of grooves in the second mating section, wherein the plurality of lips surround at least a portion of each one of the first plurality of electrical connectors and the plurality of grooves surround at least a portion of each one of the second plurality of electrical connectors. Each groove may be configured to receive one lip to form an interference fit connection.

The method may further include slidably positioning an outer shell over the mated first connector structure and second connector structure. The outer shell may include a pair of channels encircling an inside circumference of the outer shell. Each channel may be configured to retain a first snap ring on the first connector structure and a second snap ring on the second connector structure.

An interference fit may be formed between a portion of the inside circumference of the outer shell and a first o-ring on the first connector structure and a second o-ring on the second connector structure. The interference fit may prevent passage of fluids between the o-rings and inside circumference of the outer shell.

The method also may include inserting a first cable into a first cable receptacle of the first connector structure and inserting a second cable into a second cable receptacle of the second connector structure. A first outer tube may be placed over the first cable and cable receptacle and a second outer tube may be placed over the second cable and cable receptacle. The outer tubes prevent fluid from entering the connector structures.

In another general aspect, an electrical connector assembly includes a first connector structure, a second connector structure, a plurality of first electrical connectors, and a plurality of second electrical connectors. The first connector structure defines a first substantially planar first connector surface. The second connector structure defines a second substantially planar second connector surface. A plurality of first electrical connectors are disposed within the second substantially planar surface, and the first electrical connectors extend in a direction substantially perpendicular to the first substantially planar surface. A plurality of second electrical connectors are disposed within the second substantially planar surface, and the second electrical connectors are oriented to receive the first electrical connectors upon overlapping engagement of the first connector structure and the second connector structure.

Embodiments may include one or more of the following features. For example, the connector assembly also may include a first cable receptacle formed in the first connector structure for receipt of a first cable having a plurality of first conductors and a second cable receptacle formed in the second connector structure for receipt of a second cable having a plurality of second conductors. A first inner region may be formed in the first cable receptacle, the first inner region configured for receipt and routing of the first conductors to the first electrical connectors. A second inner region may be formed in the second cable receptacle, the second inner region configured for receipt and routing of the second conductors to the second electrical connectors.

The connector assembly also may include a retention member that holds the first and second connector structures together. A first o-ring may be mounted in a first channel of the first connector structure and a second o-ring may be mounted in a second channel of the second connector structure, wherein the o-rings are configured to form interference fits with at least a portion of the retention member. The plurality of first electrical connectors may be potted to the first substantially planar connector surface with epoxy and the plurality of second electrical connectors may be potted to the second substantially planar connector surface with epoxy.

The first connector structure may include a plurality of lips and the second connector structure may include a plurality of grooves. Each groove may be configured to receive a lip to form an interference fit connection in which each connection is fluid resistant and resists separation of the first connector structure from the second connector structure.

In another general aspect, a strain relief mechanism includes a chamber and a ball that accommodate a plurality of wires. The chamber has a first end and a second end. The second end defines a lip having an inner diameter that is less than the diameter of the chamber. The ball is disposed within the chamber and has a diameter that is less than the inner diameter of the chamber but is greater than the inner diameter of the lip. The wires pass around the outside circumference of the ball. The strain relief mechanism may be implemented in an inline electrical connector or in a cardiac assist system.

Embodiments may include one or more of the following features. For example, in the strain relief mechanism the ball may include a channel having a first opening adjacent to the lip and a second opening adjacent to the second end of the chamber. The strain relief mechanism may further include a fiber bundle passing from the first end of the chamber to the second end of the chamber through the channel in the ball. The fiber bundle may be tied into a knot between the second opening and the second end. Epoxy may be applied to the knot to secure the knot.

A ring may be disposed in the chamber adjacent to the second end of the chamber. A layer may surround the wires and the layer may be secured to the ring.

The strain relief mechanism may include an insulator within the chamber adjacent to the second end and comprising a plurality of slotted channels. The wires may pass through the slotted channels. The insulator may have a greater outer diameter than the inner diameter of the chamber when the insulator is outside of the chamber. The insulator may be made of an insulative polymer, such as a homopolymer acetal resin.

In another general aspect, a method of providing strain relief to a plurality of wires includes providing a chamber, providing a ball, providing a plurality of wires, placing the ball within the chamber, and passing the wires through the chamber, around the ball.

Embodiments may include one or more of the following features. For example, the ball may include a channel, and a fiber bundle may be passed through the channel, tied in a knot, and adhesive applied to the knot to secure the knot.

An insulator having a plurality of slotted channels may be placed in the chamber adjacent to the second end and the plurality of wires passed through the channels. The outer diameter of the insulator may be greater than the inner diameter of the chamber when the insulator is not in the chamber.

The inline electrical connector can offer the considerable advantage of providing a connection between two cables with a minimized length and diameter. It also can offer the advantage that the two housings of the connector will neither rotate with respect to each other nor axially separate from each other. Finally, the outer shell can provide the advantages of preventing separation of the housings and protection of the housings and electrical connections from fluids. Overall, these possible advantages provide a considerable advantage for implantable axial-flow blood pumps because the inline electrical connector can be implanted in the body. Once implanted, the inline connector occupies less space than conventional electrical connectors. It also resists failure due to separation of the housings or fluid penetration into the housings. Because the connector has a minimized length and diameter, it is conducive to the mating and bending of short cables in the confined spaces of the body.

The strain relief mechanism can offer the advantage of preventing the wires from being pulled out of the connector, which could interrupt power and cause a short circuit.

Other advantages, features, and embodiments of the present invention will become apparent from the following detailed description and claims.

FIG. SC is a perspective view of a female electrical socket.

Figure 5A:
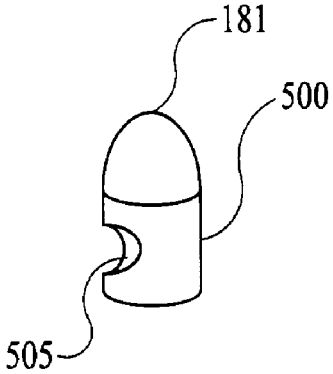
FIG. 5A is a perspective view of a male electrical pin.
Figure 5C:
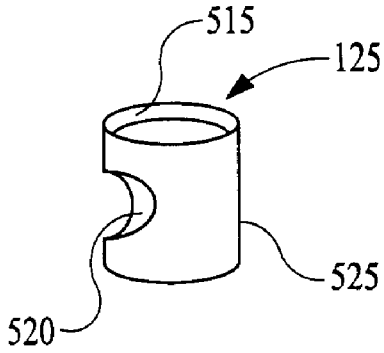
FIG. 5B is a perspective view of the male electrical pin of FIG. 5A incorporating a conductor.
Figure 5B:
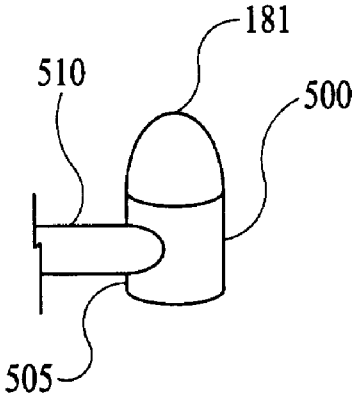
Figure 5D:
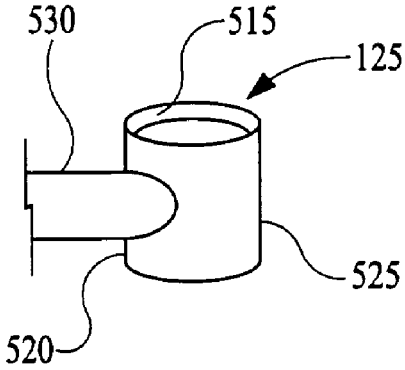

FIG. 5D is a perspective view of the female electrical socket of FIG. 5C incorporating a conductor.

Figure 6A:
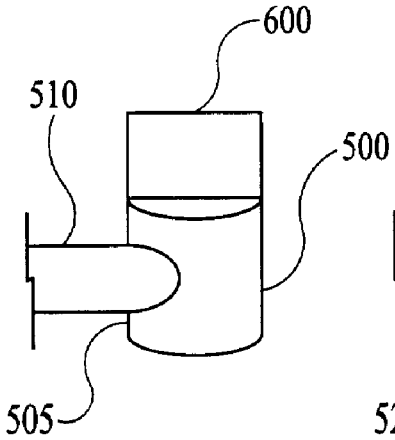

FIG. 6A is a perspective view of a single blade connector.

Figure 6B:
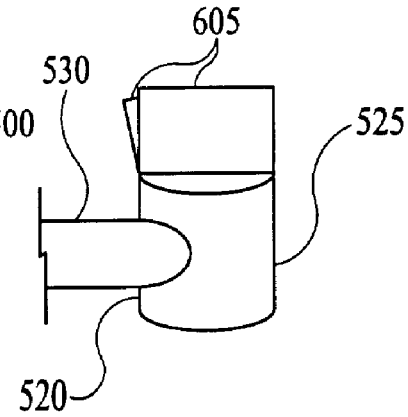

FIG. 6B is a perspective view of a spring-biased blade connector.

Figure 7A:
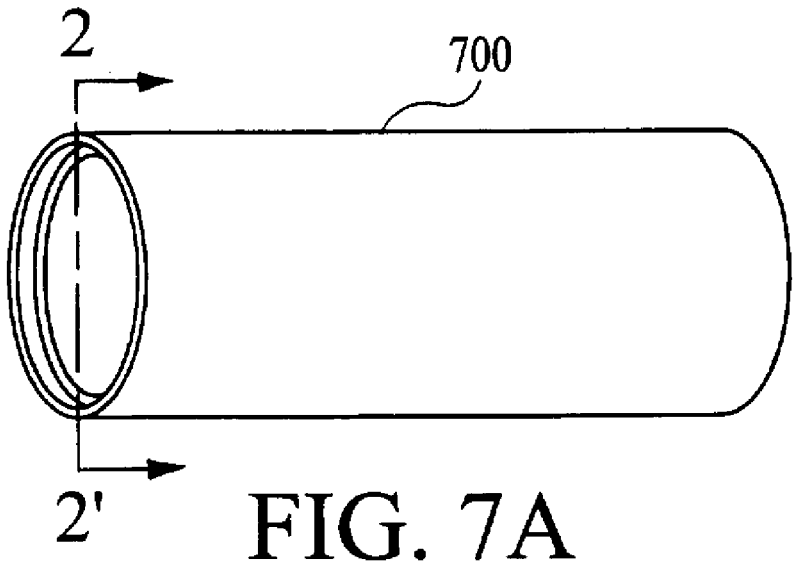

FIG. 7A is a perspective view of an outer shell.

Figure 7B:
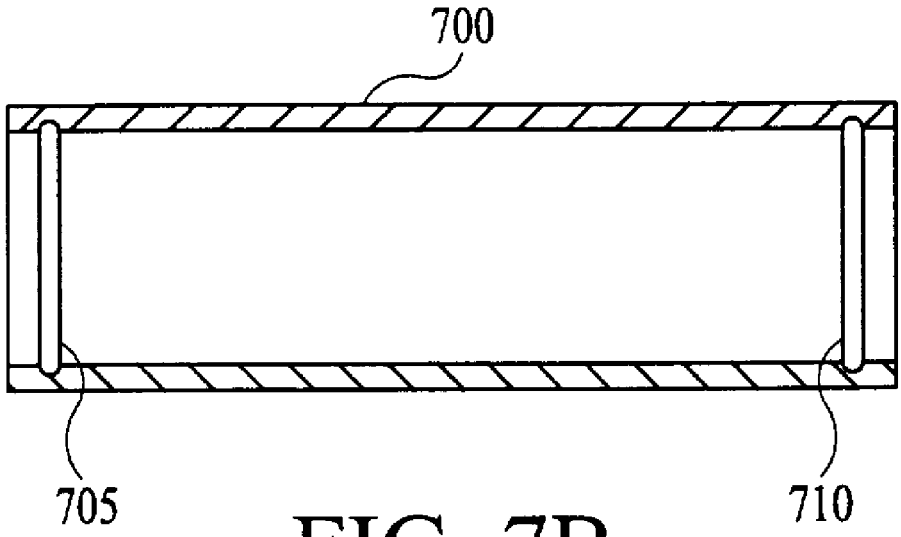

FIG. 7B is a cross-sectional side view of the outer shell of FIG. 7A taken along line 2–2'.

Figure 1A:
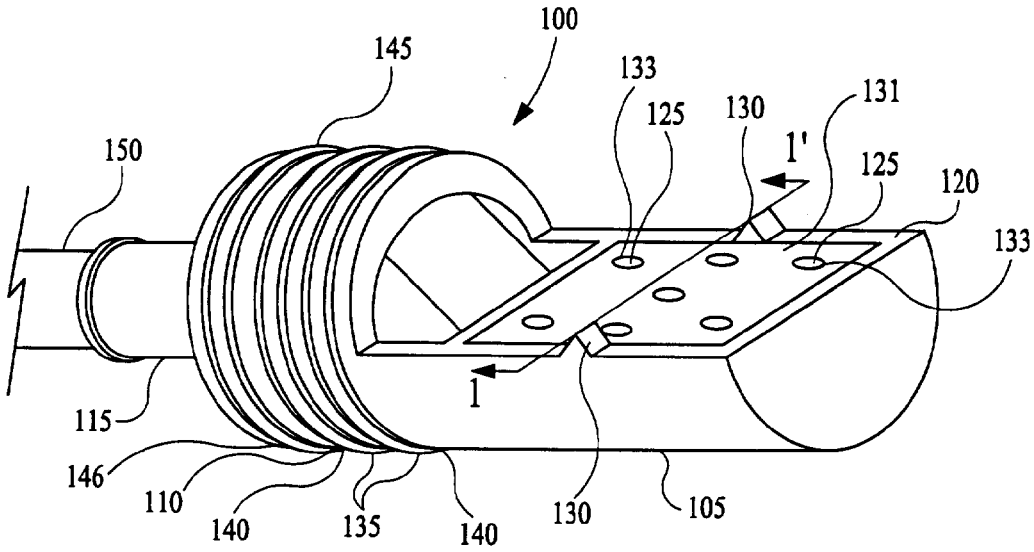
FIG. 1A is a perspective view of a female housing shell of an inline electrical connector.
Figure 1D:
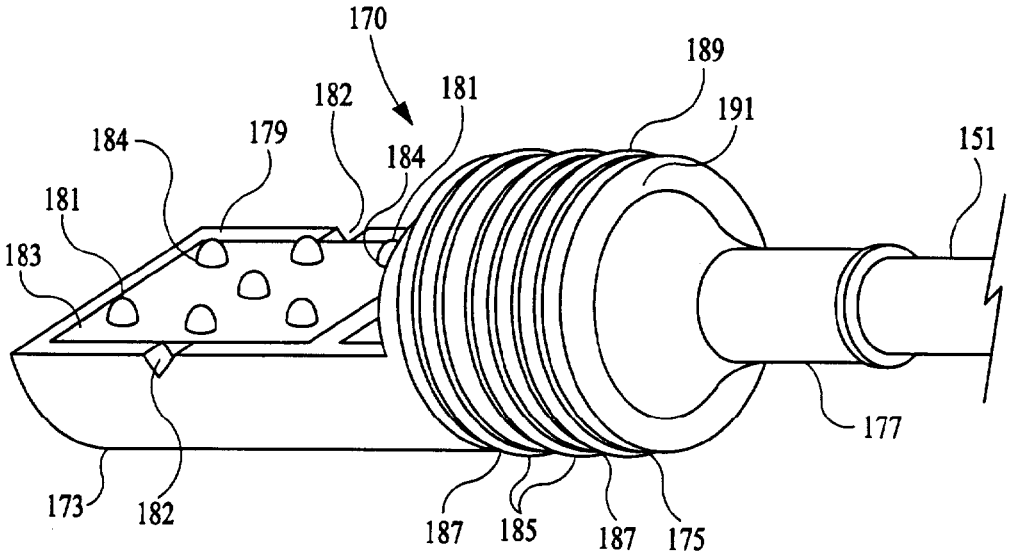
FIG. 1D is a perspective view of a male housing of an inline electrical connector
Figure 8A:
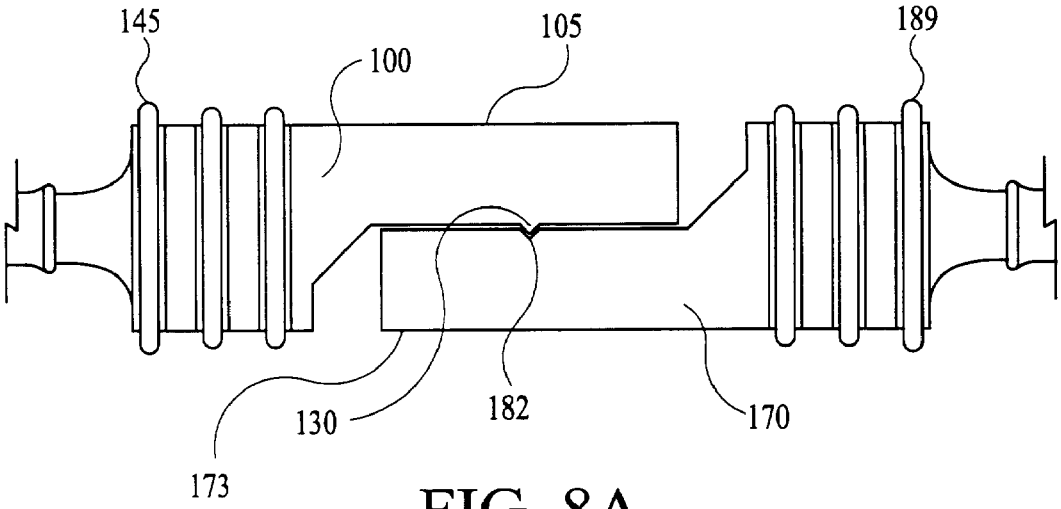

FIG. 8A is a side view of the female housing of FIG. 1A connected to the male housing of FIG. 1D.

Figure 8B:
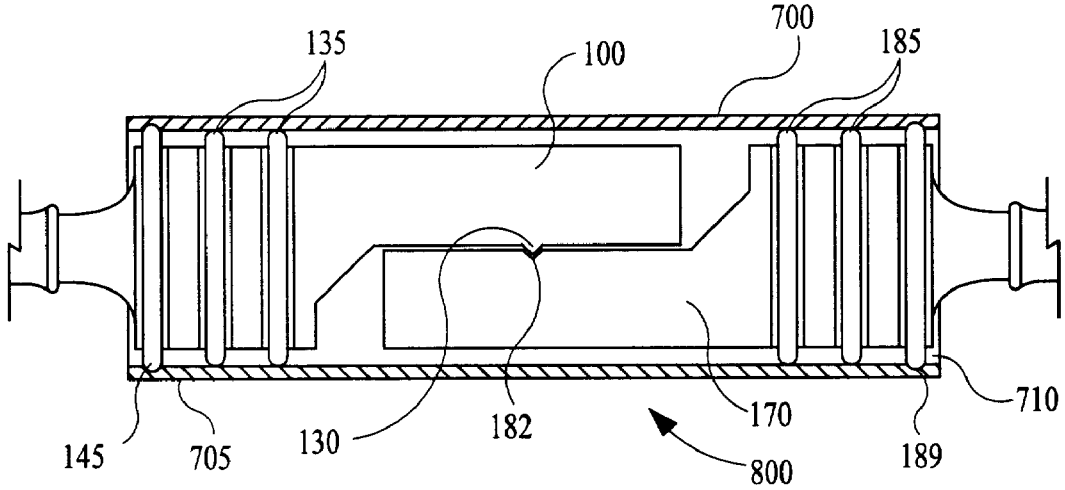

FIG. 8B is a partially cut-away side view of the connected housings of FIG. 8A surrounded by the outer shell of FIG. 7A.

Figure 8C:
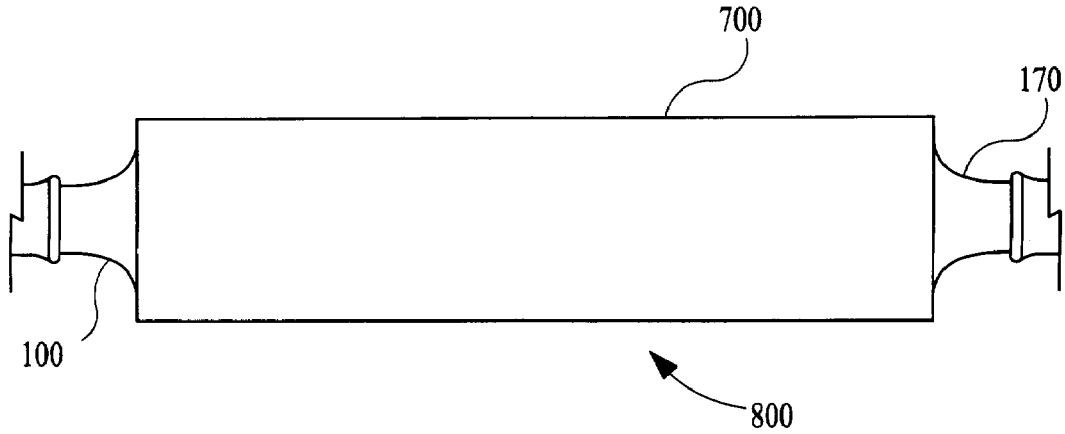

FIG. 8C is a side view of the connected housings and outer shell of FIG. 8B.

Figure 9A:
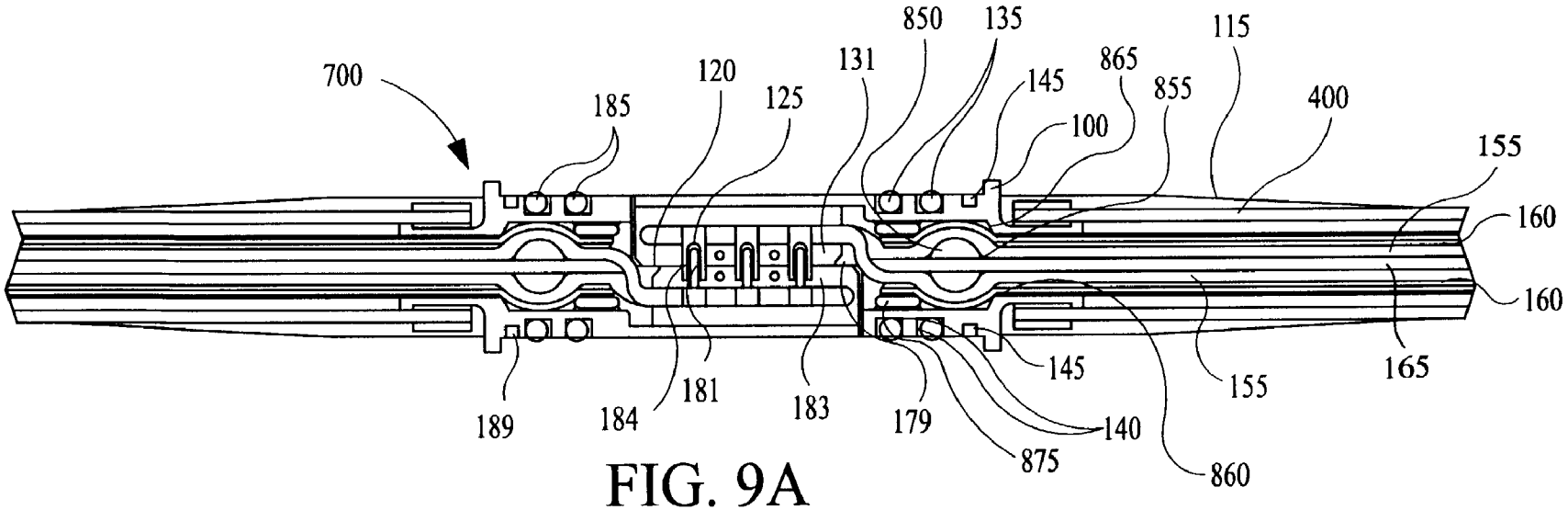

FIG. 9A is a cut-away side view of the connected housings of FIG. 8B showing a strain relief mechanism.

Figure 9B:
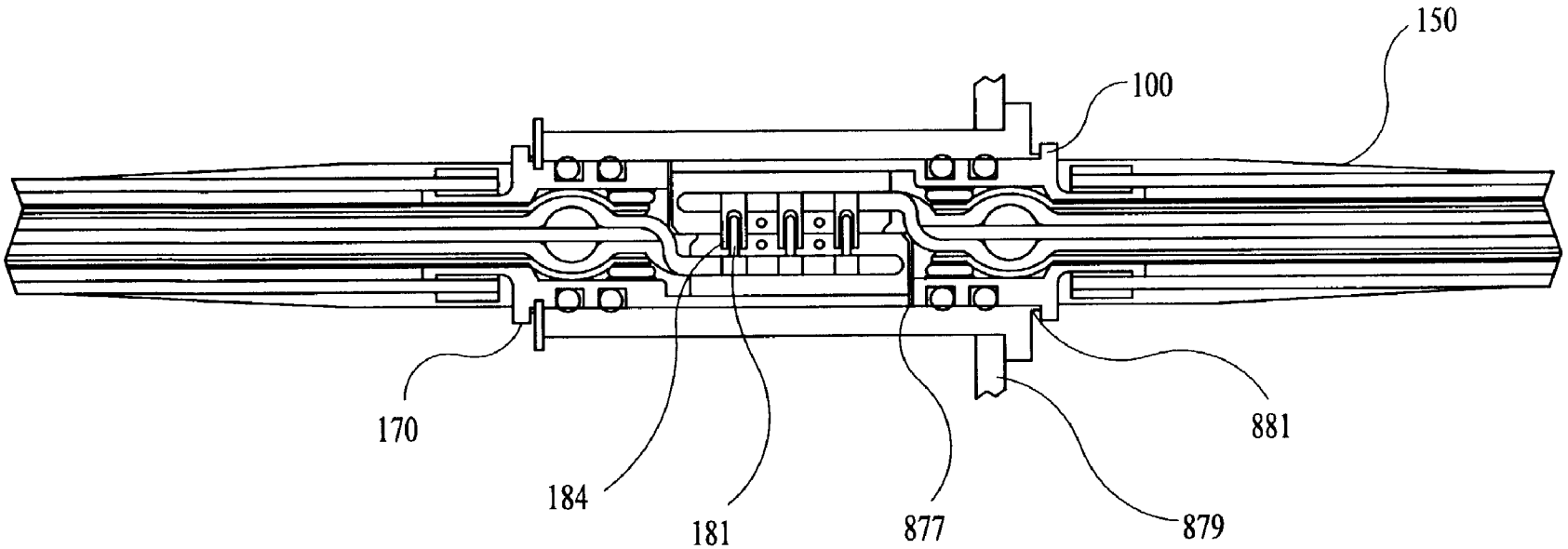

FIG. 9B is a cut-away side view of the inline electrical connector having a strain relief mechanism and installed in the wall of a piece of equipment.

Figure 9C:
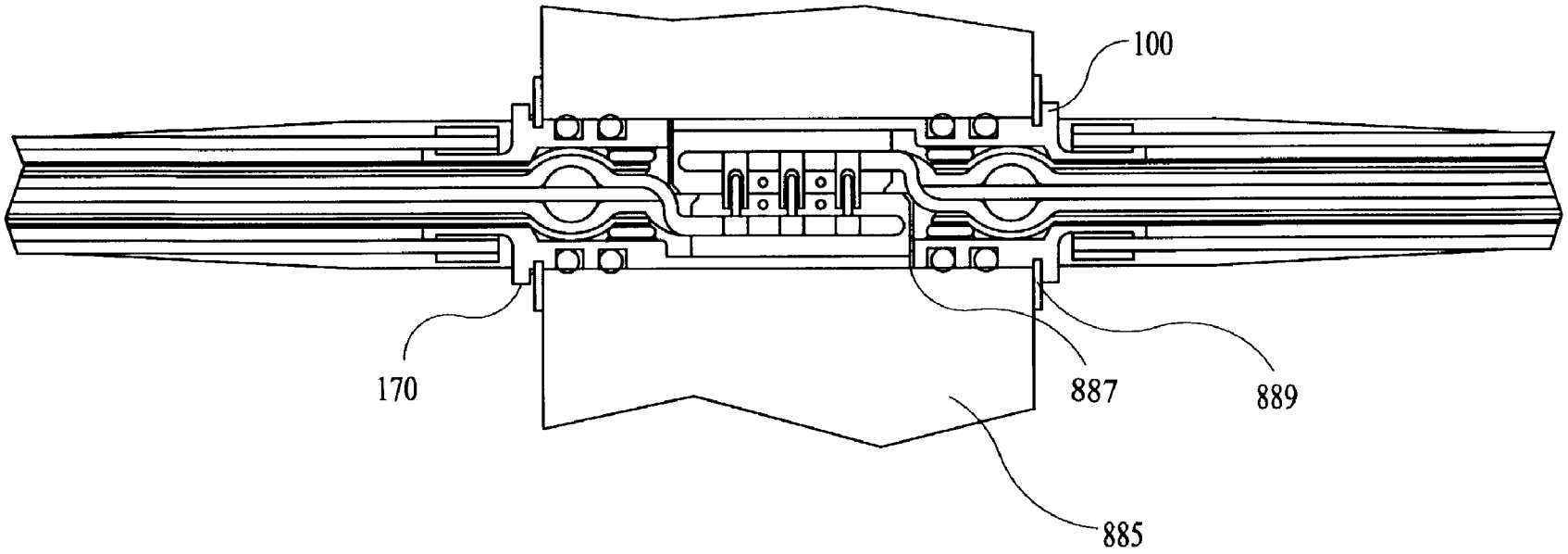

FIG. 9C is a cut-away side view of the inline electrical connector having a strain relief mechanism and installed in an electrical or data panel.

Figure 9E:
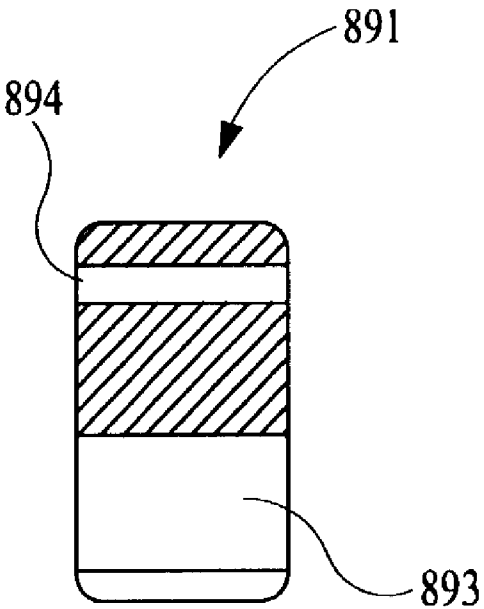
Figure 9D:
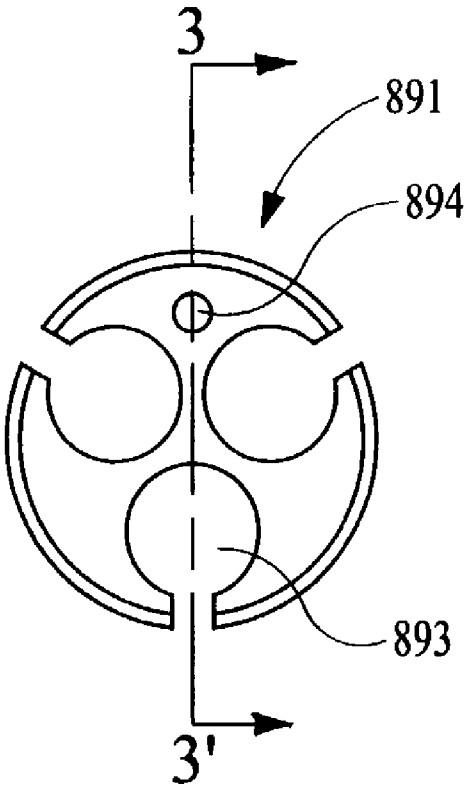

FIG. 9D is a front view of a strain relief insulator.

FIG. 9E is a cross-sectional view of the insulator of FIG. 9D taken along line 3–3'.

Figure 10A:
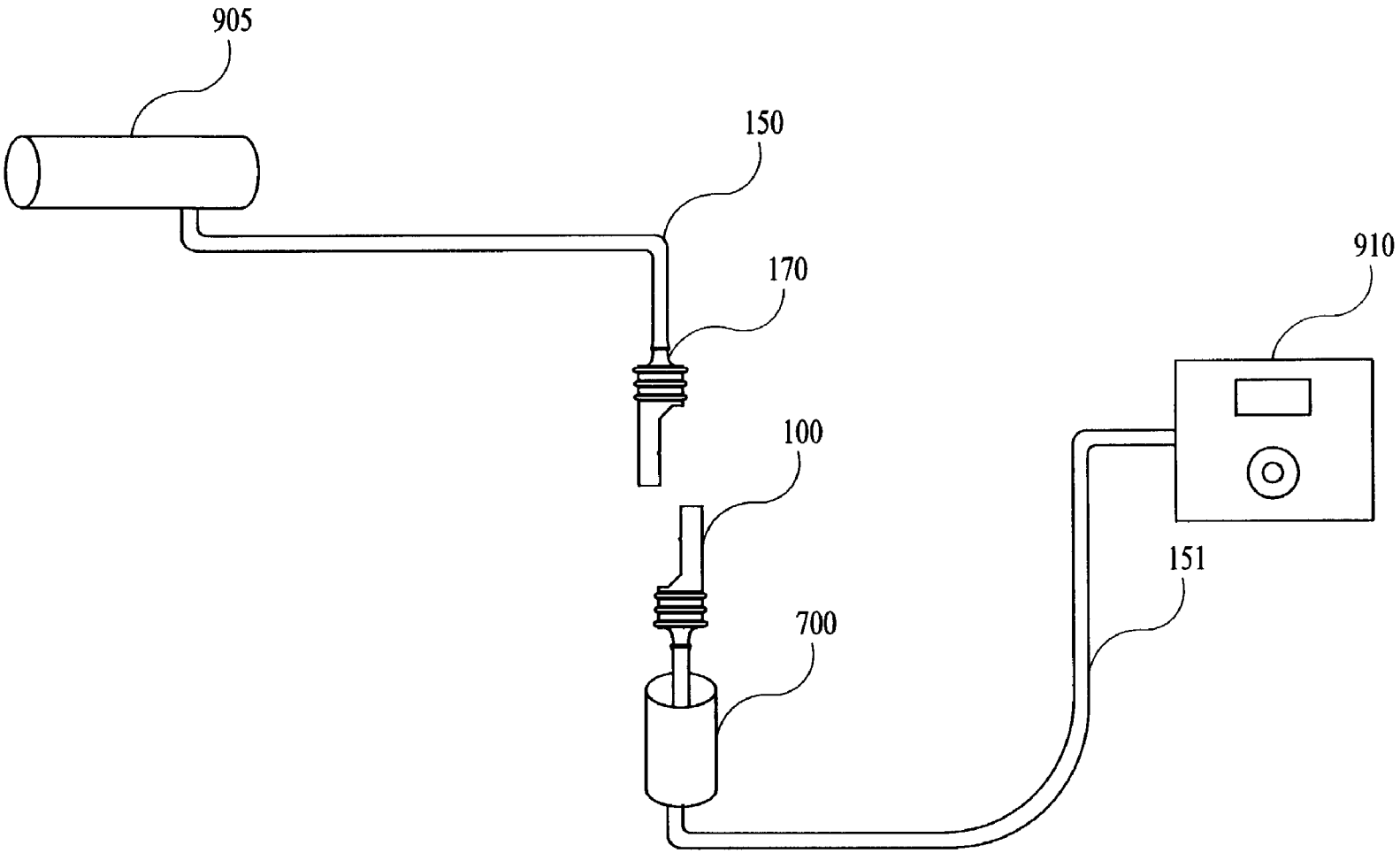

FIG. 10A is a conceptual view of a blood pump system.

Figure 10B:
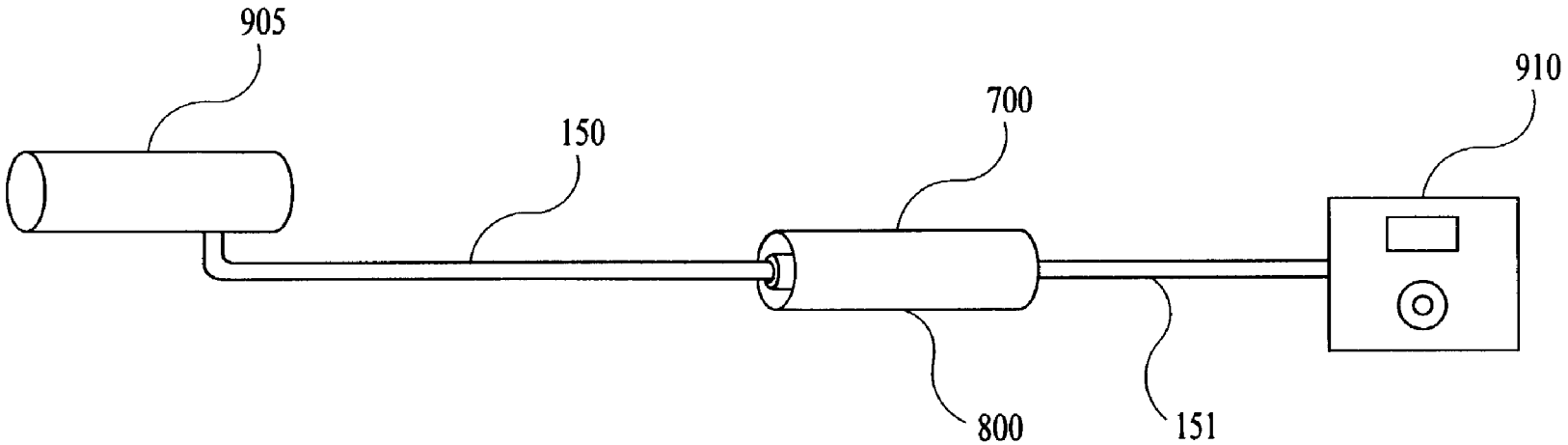

FIG. 10B is a conceptual view of the blood pump system of FIG. 10A in a connected condition.

Figure 11:
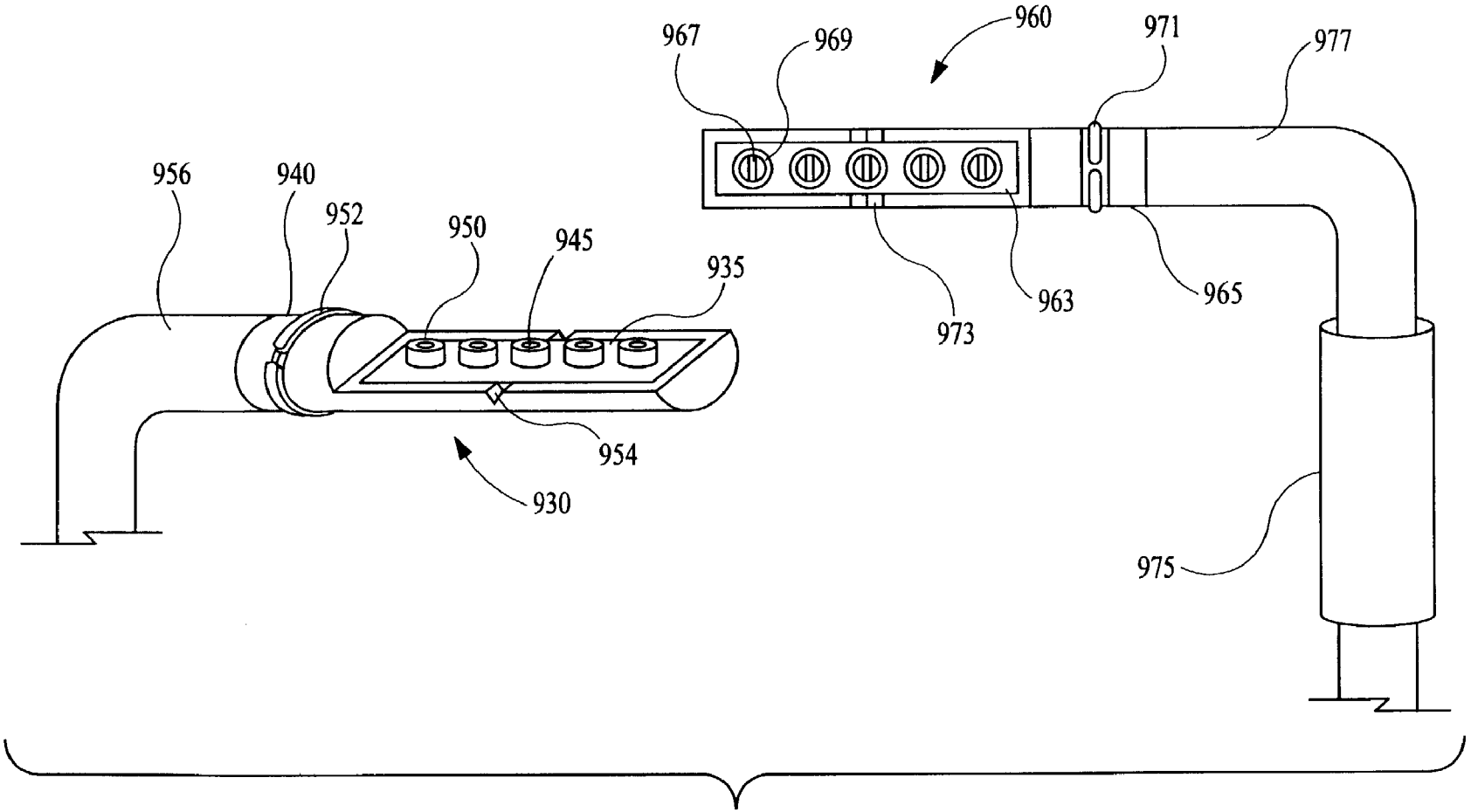

FIG. 11 is a conceptual view of an inline connector for a space-limited application.

Like reference numbers and designations in the various drawings indicate like elements.

DETAILED DESCRIPTION

FIG. 1A is a perspective view of a female housing shell 100 (i.e., a connector structure) of an inline electrical connector. Female housing shell 100 includes three integral components: a mating section 105, a fluid barrier section 110, and a cable entrance 115 (i.e., a cable receptacle). Mating section 105 has a semicircular profile along its axial length and includes a mating surface 120. Mating surface 120 includes a plurality of female electrical sockets 125 (i.e., electrical connectors), a pair of interlocking fingers 130, and an insulating member 131. Insulating member 131 defines a substantially planar connector surface. Insulating member 131 is inserted into housing shell 100 and cross-pinned to the shell. In a cross-pinning of two connected parts, as is well known in the art, a hole is drilled through both parts along an axis perpendicular to the direction one part would travel if it fell free of the other part. A dowel or other type of pin is pressed into the drill hole thereby cross-pinning one part to the other part. A plurality of channels 133 passing through insulating member 131 receive and retain the female electrical sockets 125.

FIG. 1A shows seven female electrical sockets 125 and seven channels 133 for exemplary purposes only. The number of sockets and channels is determined based on the application. For example, if the inline electrical connector is used in the connection of a blood pump and controller/power module, electrical power, data and control signals may be transmitted through the cable. In a blood pump application, the number of sockets and channels is based on the power, data collection, and control requirements of the blood pump.

Fluid barrier section 110 has a circular profile along its axial length and includes a pair of o-rings 135. The o-rings 135 encircle the circumference of the fluid barrier section 110 and are seated in a pair of channels 140 that also encircle the circumference of the fluid barrier section. A snap ring 145 is located in a groove 146 that encircles the circumference of the fluid barrier section 110. O-rings 135 may be formed from an elastomeric material, whereas snap ring 145 may comprise a substantially rigid material. As an example, snap ring 145 may be internally molded with fluid barrier section 110.

Figure 1B:
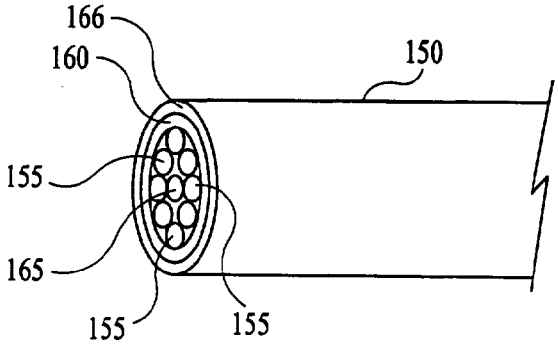
FIG. 1B is a perspective view of an electrical cable.

Referring also to FIG. 1B, an electrical cable 150 is inserted into the female housing shell 100 through cable entrance 115 and potted with epoxy or another suitable material. The cable 150 includes a plurality of electrically conductive wires 155 that are surrounded by a woven wire layer 160 encircling the plurality of individual conductive wires 155. Woven wire layer 160 functions as an electrical shield. An outer layer 166 of polymer surrounds woven wire layer 160. Cable 150 also includes a bundle of high-tensile strength fibers 165 that extend the entire length of the cable. The fibers 165 may be embedded within the connector with epoxy to provide strain relief for the cable.

Figure 1C:
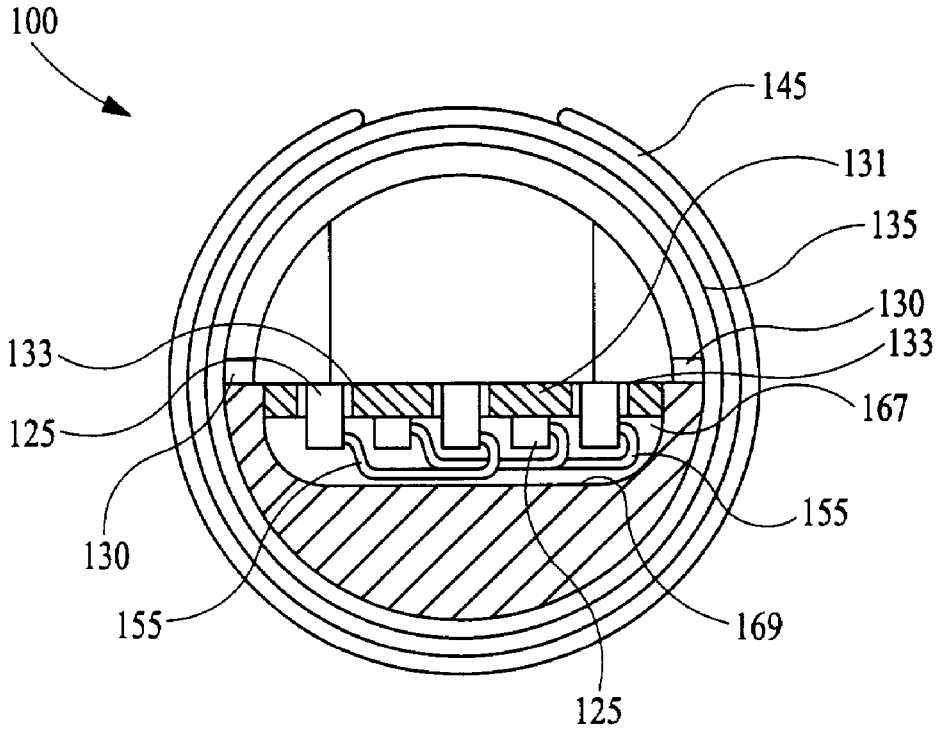
FIG. 1C is a cross-sectional end view of the female housing shell shown in FIG. 1A taken along line 1–1' of FIG. 1A.
Figure 2A:
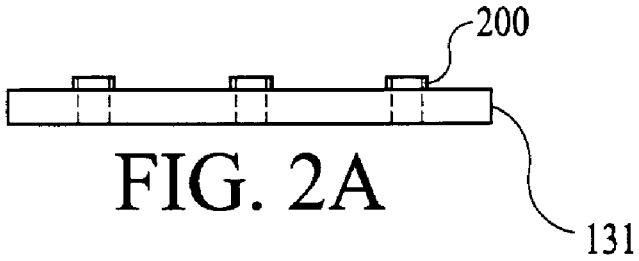
FIG. 2A is a side view of an insulating member with lips.
Figure 2B:
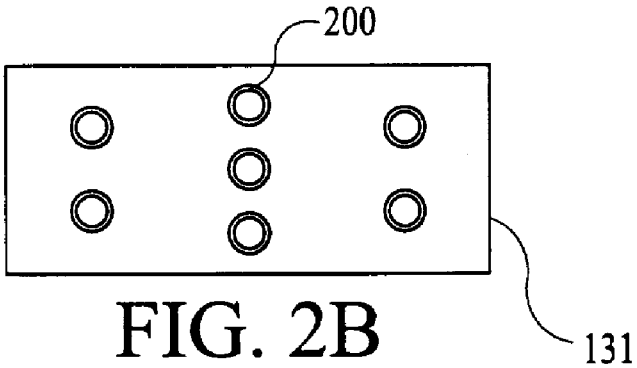
FIG. 2B is a top view of the insulating member of FIG. 2A.
Figure 2C:
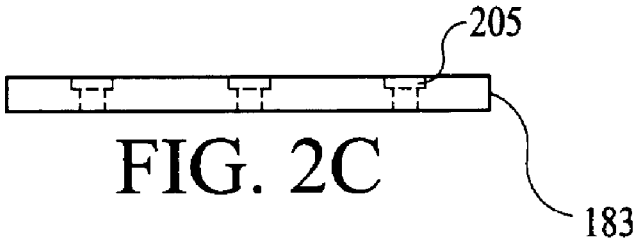
FIG. 2C is a side view of an insulating member with a plurality of grooves.
Figure 2D:
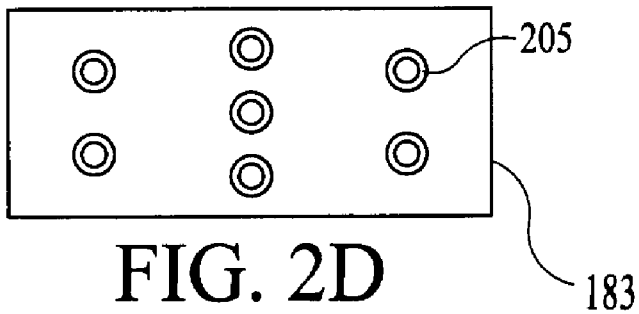
FIG. 2D is a top view of the insulating member of FIG. 2C.
Figure 3A:
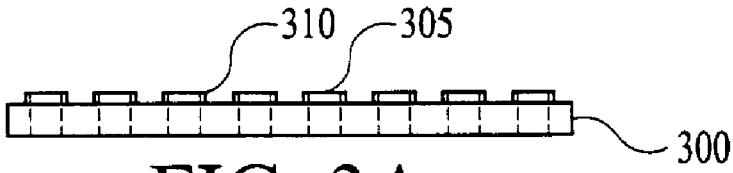
FIG. 3A is a side view of an elongated insulating member with axially spaced channels and lips.
Figure 3B:
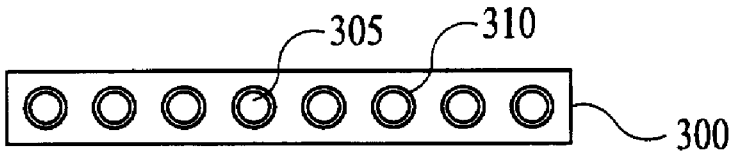
FIG. 3B is a top view of the elongated insulating member of FIG. 3A.
Figure 3C:
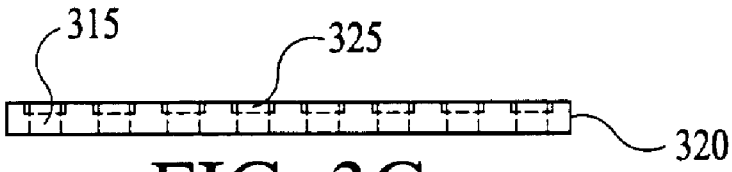
FIG. 3C is a side view of an elongated insulating member with axially spaced channels and grooves.
Figure 3D:
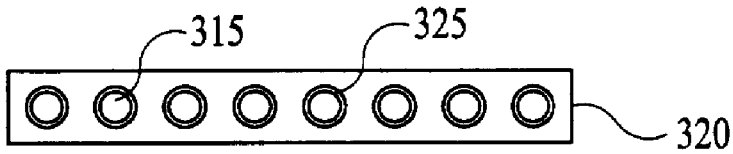
FIG. 3D is a top view of the insulating member of FIG. 3C.

Referring also to FIG. 1C, which is a cross-sectional end view of female housing shell 100, the female housing shell has an inner region 167 in which electrical wires 155 extend from cable 150 to connect to female sockets 125 that are potted in channels 133. Wires 155 can be connected to sockets 125 by soldering. Inner region 167 has a generally flat bottom 169 that is specified to have just enough depth to contain wires 155 when they are connected to sockets 125. By providing a shallower rather than deeper inner region 167, flat bottom 169 provides resistance against the dislodgement of sockets 125 into inner region 167. Inner region 167 may be formed by machining or during the injection molding or casting of housing shell 100.

FIG. 1D is a perspective view of a male housing shell 170 of an inline electrical connector. Male housing shell 170 includes three integral components: a mating section 173, a fluid barrier section 175, and a cable entrance 177. Mating section 173 has a semicircular profile along its axial length and has a mating surface 179 that includes a plurality of male electrical pins 181 (i.e., electrical connectors), a pair of notched regions 182, and an insulating member 183. Notched regions 182 are arranged for engagement with fingers 130 upon mating of shells 100, 170 to secure the shells against axial displacement. Insulating member 183 defines a substantially planar connector surface. Insulating member 183 is inserted into housing shell 170 and also cross-pinned to the shell. A plurality of channels 184 passing through insulating member 183 receive and retain the male electrical pins 181 that are connected to electrically conductive wires. Like female housing shell 100, male housing shell has an inner region (not shown) through which the wires pass from cable entrance 177 to electrical pins 181.

FIG. lD shows seven male electrical pins 181 and seven channels 184 for exemplary purposes. As described above with respect to the number of sockets and channels in which the sockets are disposed, the number of pins and channels in which the pins are disposed also is determined based on the requirements of the particular application in which the connector is used.

Fluid barrier section 175 is circular along its axial length and includes a pair of o-rings 185. The o-rings encircle the circumference of the fluid barrier section 175 and are seated in a pair of channels 187 that also encircle the circumference of the fluid barrier section. A snap ring 189 is located in a groove 191 that encircles the circumference of the fluid barrier section 175. Electrical cable 151 is inserted into the male housing shell 170 through cable entrance 177 and is potted with epoxy or another suitable material.

Female housing 100 and male housing 170 may be made of a biocompatible polymer such as polycarbonate-urethanes. O-rings 135 and 185 may be made of a lower durometer biocompatible polymer such as silicone or ethylene propylene. Snap rings 145 and 189 may be made of a biocompatible polymer such as polycarbonate-urethanes or a biocompatible metal such as titanium. The insulating members 131 and 183 may be made of a biocompatible polymer with insulative properties such as a homopolymer acetal resin. The outer layer of cables 150 and 151 may be made from a biocompatible polymer such as polycarbonate-urethane. The pins 181 and sockets 125 may be made of a conductive metal such as brass or beryllium-copper that is gold-plated to improve electrical conductivity and resist corrosion.

Referring to FIGS. 2A–2D, insulating member 131 may have a lip 200 that mates with a groove 205 of insulating member 183 when male housing shell 170 is mated with female housing shell 100. The outer diameter of lip 200 is slightly larger than the inner diameter of groove 205. The difference in diameters is specified to provide an interference fit between the lip and groove. The interference fit provides additional resistance to the separation of male housing 170 and female housing 100 when they are mated. It also provides protection against the penetration of fluid into the conduction path formed between electrical sockets 125 and electrical pins 181.

Insulating members 131 and 183 with channels 133 and 184, respectively, may be made by machining, casting, or injection molding. Insulating members 131, 183 with lips 200 and grooves 205, respectively, may be made by similar processes. If insulating members 131, 183 are injection molded without channels, however, channels 133, 184 may be drilled or bored. Grooves 205 also may be drilled or bored. There could be tracks (not shown) to allow routing of conductors. The tracks could be formed during molding or machined from a previously molded component.

In one embodiment, insulating members can be constructed in an elongated shape in which respective sockets and pins are arranged to extend longitudinally along a single row. Referring to FIGS. 3A–3D, a first elongated insulating member 300 includes a plurality of channels 305 and lips 310. The channels 305 are axially spaced along the length of first elongated insulating member 300 to mate with a plurality of channels 315 on a second elongated insulating member 320. The plurality of lips 310 fit within a plurality of grooves 325. The diameter of lips 310 is larger than the diameter of grooves 325 so that a water-resistant interference fit is formed between lips 310 and grooves 325.

The length and width of elongated insulating members 305 and 320 are based upon the number of wires in the cable with which the insulating members are used. For example, if there are few wires in the cable (i.e., two or three) to be connected, the length may be shorter than if there are many wires (i.e., nine or ten) in the cable and the width is held constant. The width also may be increased as the number of wires in the cable is increased. However, if the intent is to ensure that the inline connector has a diameter close to the diameter of the cable to which it is attached, the maximum width of the insulating member should be close to that of the cable. Therefore, if there are additional wires in the cable, the length of the insulating member, by necessity, would be increased.

Figure 4A:
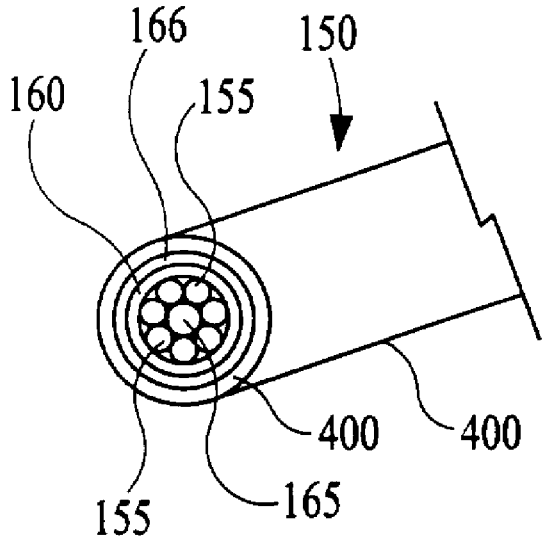
FIG. 4A is a perspective view of an electrical cable with an outer tube.
Figure 4B:
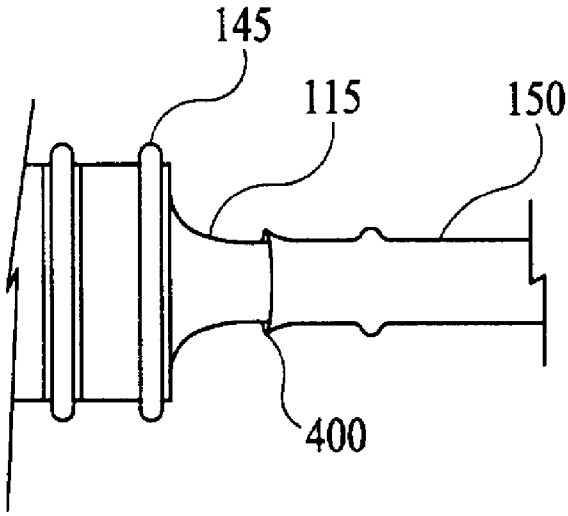
FIG. 4B is a side view of the electrical cable of FIG. 4A connected to a housing.

Referring to FIGS. 4A and 4B, electrical cable 150 may have an outer tube 400 that runs its entire length. Tube 400 is passed over cable entrance 115 or 177 (177 not shown) and secured against the entrance to provide increased protection from fluid penetration. Tube 400 may be secured by clamping, heat shrinking, or forming an interference fit. Tube 400 may be made of a biocompatible polymer such as silicone.

Referring to FIGS. 5A–5D, male electrical pin 181 has a base 500 with an opening 505. Opening 505 is formed by drilling into base 500 at an angle perpendicular to male pin 181 or by casting the base with the opening. An individual conductor 510 is inserted into opening 505 and soldered or crimped to base 500 to provide conductive coupling between the conductor and pin 181.

Female electrical socket 125 includes a first opening 515, configured to receive male pin 181, and a second opening 520. Second opening 520 is formed by drilling into a base 525 at an angle perpendicular to first opening 515 or casting. An individual conductor 530 is inserted into second opening 520 and soldered or crimped to base 525 for conductive coupling.

During assembly of the female housing 100, female sockets 125 are passed through cable entrance 115 and inner region 167 and placed in channels 133 of insulating member 131. The sockets are then potted in place with, for example, a biocompatible epoxy such as Epo-Tek 301 or 302 made by Epoxy Technology of Billerica, Mass. The male pins 181 are assembled in male housing 170 in a similar manner.

Referring to FIGS. 6A and 6B, male pin 181 may be replaced by a single, flat blade 600 and female socket 125 may be replaced with a spring-biased pair of blades 605 configured to receive and retain single blade 600. Individual conductors 510 and 530 are inserted into openings 505 and 520, respectively, and soldered to bases 500 and 525, respectively. During use, single flat blade 600 is inserted into the pair of spring-biased blades 605. The spring biasing design of the blades 605 provides an interference fit that contributes to retaining the blade 600 within blades 605 and ensuring electrical conduction with increased coupling pressure between blade 600 and blades 605.

Referring to FIGS. 7A and 7B, an inline electrical connector also may include a tubular outer shell 700. Outer shell 700 is hollow and includes a first channel 705 and a second channel 710 that encircle the inside circumference of shell 700. Outer shell 700 may be made from a rigid, biocompatible polymer such as polycarbonate-urethanes.

Referring to FIGS. 8A–8C, female housing 100 may be mated to male housing 170 by inserting male electrical pins 181 into female electrical sockets 125 (not shown) and interlocking fingers 130 into notched regions 182. When retained within the outer shell 700, the semicircular shapes of the mating sections 105 and 173 prevent rotation of the housings with respect to each other.

Similarly, after insertion of the interlocking fingers 130 into the notched regions 182, outer shell 700 prevents axial separation of the housings.

To form an inline electrical connector 800, outer shell 700 is placed over mated housings 100 and 170 until snap rings 145 and 189 form interference fits within channels 705 and 710, respectively. O-rings 135 and 185 form compression fits with the inside of outer shell 700 that seal the connector interior against moisture and fluid. Placing outer shell 700 over mated housings 100 and 170 prevents separation of the housings. The interference fit between the snap rings 145, 189 and channels 705, 710, respectively, prevents outer shell 700 from being accidentally dislodged, although the outer shell can be removed when disconnection of the mated housings is necessary. The compression fit between the o-rings 135, 185 and outer shell 700 prevents fluid from leaking past the o-rings and between the housings, which could cause an electrical short in the electrical conduction path formed between the plurality of electrical sockets 125 and electrical pins 181.

Referring to FIG. 9A, the inline electrical connector may have an internal strain relief mechanism to prevent disturbance of the solder joints of the pins 181 and sockets 125. In addition, the internal strain relief mechanism is designed to resist the wires from being pulled out of the housing shells. For example, female housing 100 includes a ball 850 having a channel 855 passing through its center. Fiber bundle 165 passes through channel 855 and wires 155 pass around the outer surface of ball 850. Ball 850 is disposed within a chamber 860 of female housing 100. The chamber 860 has a lip 865 or transition in diameter where the inside of cable entrance 115 begins. The lip 865 has an inner diameter smaller than the outer diameter of ball 850, which keeps ball 850 within housing 100.

Fiber bundle 165 is pulled through channel 855, tensioned, and a knot (not shown) made such that bundle 165 cannot pass back through the channel. Epoxy is applied to secure the knot. The tension in bundle 165 is generated by slightly shortening the length of bundle 165 relative to the length of the wires 155. This has the effect of transmitting cable strain loads through the bundle 165 to ball 850 rather than to the solder joints. In the housing 100, the layer 160 is pulled back from one end of cable 150 and attached to a ring 875 that encircles the inner circumference of chamber 860. Layer 160 is secured to the ring 875 by compressing layer 160 against the connector housing 100. This creates an interference fit between the ring 875 and the connector housing 100, thereby providing electrical continuity between the layer 160 and the housing 100. This continuity is maintained between the first and second connector housings 100 and 170, respectively, by soldering several strands of layer 160 to an unused connector pin or socket. Also, in the event a fiber bundle, such as fiber bundle 165, is not used in the cable assembly, the ring 875 can be sized to retain the ball 850 within the connector chamber 860. Housing 170 has a similar strain relief mechanism.

If ball 850 does not have a channel 855, bundle 165 passes around the ball rather than through it. In use, the strain relief prevents wires 155 from being pulled out of housing 100 by the movement of ball 850 against lip 865. If cable 150 is bent or pulled away from housing 100, the wires 155 are pulled together, which pulls ball 850 toward lip 865. If cable 150 is pulled hard or continuously, the movement of the wires 155 against ball 850 presses the ball against the wires, which presses the wires against the lip 865. Once the ball 850 presses the wires against the lip 865, there will be no more movement of the wires relative to the lip or ball.

FIGS. 9B–9C illustrate the strain relief mechanisms used in other applications of the inline electrical connector. For example, the inline electrical connector may be inserted in a wall of a piece of equipment. Referring to FIG. 9B, the male housing 170 is permanently attached to a channel 877 in a wall 879 of a piece of equipment. Female housing 100 is inserted into an opening 881 of channel 877. This application could, for example, be a computer in which housing 100 connects a printer (not shown) to a computer in which wall 879 functions as a portion of the panel of the computer to which peripherals are attached.

Male pins 181 are configured to have the ability to be recessed from their extended position back into channels 184 and spring back to the extended position by, for example, a spring mechanism in channel 184. In this manner, female housing 100 can be inserted and removed from channel 881.

Referring to FIG. 9C, the strain relief mechanisms may be used in a piece of equipment having a thick wall 885 such as, for example, a portion of an electrical or data panel to which connections are made. Male housing 170 may be permanently attached in a channel 887 of wall 885. Female housing 100 may be inserted into channel 887 and male housing 170 through opening 889. The male pins 181 may be forced down into channels 184 by female housing 100. The male pins 184, however, spring back to an extended position in sockets 125 when female housing 100 is in a mating position against male housing 170.

Referring to FIGS. 9D and 9E, ring 875 may be replaced with a strain relief insulator 891 having, for example, three slotted channels 893 and a smaller diameter channel 894 that is not slotted. The wires 155 pass around the ball 850 and through individual channels 893. The woven wire layer 160 is pulled back from one end of cable 150 and wedged against the inner circumference of chamber 860 by insulator 891 when insulator 891 is positioned within the chamber 860. The outer diameter of insulator 891 is larger than the inner diameter of chamber 860. Thus, when insulator 891 is placed within chamber 860, the slotted channels 893 collapse around wires 155 and clamp them in the channels 893. When using the strain relief insulator 891 in the chamber 860, strain loads placed on cable 150 are transferred to the housing through wires 155 and insulator 891. Insulator 891 may be made of a flexible biocompatible polymer with insulative properties such as a homopolymer acetal resin. Insulator 891 may be cast, injection molded or machined.

Referring to FIGS. 10A and 10B, inline electrical connector 800 can be used to connect electrical cable 150 of a blood pump 905 to electrical cable 151 of a controller 910. During implantation of the blood pump 905, the electrical cables 150 and 151 are unconnected. Following successful implantation, the female housing 100 and male housing 170 are connected and outer shell 700 is positioned over the housings, thereby forming inline electrical connector 800, and the axial-flow blood pump 905 is tested. If the pump functions properly, the inline connector 800 is placed in a body cavity, such as the abdominal cavity, and the cable of the controller is passed out of the body through a percutaneous port. Alternatively, the controller/power module and inline electrical connector 800 can be implanted in the abdomen. The surgical incisions, through which the blood pump, connector and controller/power module were implanted, are then closed.

During the remainder of the time in which the pump 905 is implanted, the inline electrical connector 800 is rarely disconnected. The male and female housings may be disconnected, for example, if the cable from the controller malfunctions or has indications of wear and must be replaced.

The inline electrical connector may be used in applications other than blood pumps. For example, the inline electrical connector may be used to connect cables in fields in which space is limited and there are numerous cables, such as in airplane cockpits, down-hole oil well drilling equipment, telecommunications relay stations, and computer network stations. Referring to FIG. 11, an example of an inline electrical connector that may be used in applications such as these includes a first connector 930 having a substantially planar first mating surface 935, a first cable receptacle 940, a plurality of electrical connectors 945 disposed within a plurality of lips 950, a first snap ring 952, and a pair of notched regions 954. A first cable 956 is inserted within cable receptacle 940. The diameter of cable 956 is very close to the diameter of cable receptacle 940.

The inline electrical connector also includes a second connector 960 having a substantially planar second mating surface 963, a second cable receptacle 965, a plurality of electrical connectors 967 disposed within a plurality of grooves 969, a second snap ring 971, a pair of interlocking fingers 973, and a retention member 975. A cable 977 is inserted into cable receptacle 965. The diameter of cable 977 is very close to the diameter of cable receptacle 940.

In use, first connector 930 is mated to second connector 960 by inserting lips 950 into grooves 969. The diameter of the lips and the diameter of the grooves are specified to be close so that each lip forms an interference fit with a groove. The interference fit is tight enough to resist axial and lateral separation of the connectors 930 and 960.

When the first connector 930 is mated to the second connector 960, the electrical connectors 945 connect to the electrical connectors 967. If connectors 967 are implemented as pairs of spring-biased conductive blades and electrical connectors 945 are single conductive blades, each single blade is inserted between one of the pairs of spring-biased blades.

Interlocking fingers 973 are inserted into notched regions 954 to provide resistance to axial separation. Interlocking fingers 973 and notched regions 954 may be configured to also resist lateral separation.

To reduce the likelihood that first connector 930 will laterally separate from second connector 960, retention member 975 may be slid over mated connectors 930 and 960. A pair of channels (not shown) located at each end along the inner circumference of retention member 975 are configured to mate with snap rings 952 and 971.

Other embodiments are within the scope of the following claims.

What is claimed is:

1. An inline electrical connector comprising:

a first housing shell having a substantially planar first mating section and a first cable entrance section;

a second housing shell having a substantially planar second mating section and a second cable entrance section, wherein the second housing shell is configured to mate with the first housing shell, and the first mating section includes a first plurality of electrical connectors and the second mating section includes a second plurality of electrical connectors configured to mate with the first plurality of electrical connectors upon overlapping engagement of the first mating section and the second mating section; and an outer shell configured to be placed around the mated first and second housing shells;

wherein:

the first housing shell includes a first fluid barrier section and the second housing shell includes a second fluid barrier section, the fluid barrier sections configured to prevent the flow of fluids to the electrical connector, and at least one of the first housing shell and the second housing shell further includes a snap ring on one of the fluid barrier sections and the outer shell includes at least one channel on its inside circumference configured to receive and form an interference fit with the at least one snap ring to substantially prevent the outer shell from becoming dislodged upon engagement of the mating sections and placement of the outer shell about the first and second shells.

2. The inline electrical connector of claim 1, wherein the outer shell defines an inner surface sized to prevent the separation of the mated first and second housing shells.

3. The inline electrical connector of claim 1, wherein the fluid barrier sections have a circular shape.

4. The inline electrical connector of claim 1, wherein each one of the first housing shell and the second housing shell includes at least one o-ring on each one of the fluid barrier sections and each o-ring is configured to form a compression fit with a portion of the outer shell to substantially seal the mating sections against fluids upon engagement of the mating sections and placement of the outer shell about the first and second shells.

5. The inline electrical connector of claim 1, wherein the first mating section and the second mating section have a semicircular shape.

6. The inline electrical connector of claim 1, wherein the first mating section includes a pair of fingers and the second mating section includes a pair of notched regions configured to receive the pair of fingers.

7. The inline electrical connector of claim 1, wherein the other of the first housing shell and the second housing shell further includes a second snap ring on one of the fluid barrier sections and the outer shell includes a second channel on its inside surface configured to receive and form an interference fit with the second snap ring.

8. The inline electrical connector of claim 1, wherein the first plurality of electrical connectors are oriented to extend in a direction substantially perpendicular to the first mating section and the second plurality of electrical connectors are oriented to extend in a direction substantially perpendicular to the second mating section.

9. The inline electrical connector of claim 8, wherein the plurality of first electrical connectors comprises conductive sockets and the plurality of second electrical connectors comprises conductive pins configured to be placed in the conductive sockets.

10. The inline electrical connector of claim 8, wherein the plurality of first electrical connectors comprises pairs of spring-biased conductive blades and the plurality of second electrical connectors comprises conductive blades configured to be placed between the spring-biased conductive blades.

11. The inline electrical connector of claim 1, further comprising:

a plurality of lips surrounding at least a portion of each one of the first plurality of electrical connectors; and a plurality of grooves surrounding at least a portion of each one of the second plurality of electrical connectors, wherein each groove is configured to receive one lip to form an interference fit connection.

12. The inline electrical connector of claim 11, wherein the interference fit connection is fluid resistant.

13. The inline electrical connector of claim 11, wherein the interference fit connection between the lips and grooves resists separation of the first planar connector surface from the second planar connector surface.

14. The inline electrical connector of claim 13, wherein the lip and groove are cooperatively oriented to resist axial separation.

15. The inline electrical connector of claim 13, wherein the lip and groove are cooperatively oriented to resist lateral separation.

16. The inline electrical connector of claim 1, wherein the first electrical cable comprises a first end positioned in the cable entrance of the first housing shell and a second end connected to a cardiac assist device.

17. The inline electrical connector of claim 16, wherein the second electrical cable comprises a first end positioned in the cable entrance of the second housing shell and a second end connected to a controller for the cardiac assist device.

18. An inline electrical connector comprising:

a first housing shell having a substantially planar first mating section and a first cable entrance section;

a second housing shell having a substantially planar second mating section and a second cable entrance section, the second housing shell being configured to mate with the first housing shell; and an outer shell configured to be placed around the mated first and second housing shells, wherein:

the first mating section includes a first plurality of electrical connectors, the second mating section includes a second plurality of electrical connectors configured to mate with the first plurality of electrical connectors upon overlapping engagement of the first mating section and the second mating section, the first housing shell includes a first fluid barrier section and the second housing shell includes a second fluid barrier section, with the fluid barrier sections being configured to prevent the flow of fluids to the electrical connectors, each one of the first housing shell and the second housing shell includes at least one o-ring on each one of the fluid barrier sections and each o-ring is configured to form a compression fit with a portion of the outer shell to substantially seal the mating sections against fluids upon engagement of the mating sections and placement of the outer shell about the first and second shells, and at least a portion of an inner diameter of the outer shell is configured to form a compression fit with the o-rings of the first housing shell and second housing shell.

19. The inline electrical connector of claim 18, wherein the compression fit between the o-rings and the outer shell prevents fluid from passing between the o-rings and the outer shell.

20. The inline electrical connector of claim 18, wherein each of the first mating section and the second mating section has a semicircular shape.

21. The inline electrical connector of claim 18, wherein the first mating section includes a pair of fingers and the second mating section includes a pair of notched regions configured to receive the pair of fingers.

22. The inline electrical connector of claim 18, wherein the outer shell defines an inner surface sized to prevent separation of the mated first and second housing shells.

23. The inline electrical connector of claim 18, wherein the first electrical cable comprises a first end positioned in the cable entrance of the first housing shell and a second end connected to a cardiac assist device.

24. The inline electrical connector of claim 23, wherein the second electrical cable comprises a first end positioned in the cable entrance of the second housing shell and a second end connected to a controller for the cardiac assist device.

25. An inline electrical connector comprising:

a first housing shell having a substantially planar first mating section and a first cable entrance section;

a second housing shell having a substantially planar second mating section and a second cable entrance section, the second housing shell being configured to mate with the first housing shell, the first mating section including a first plurality of electrical connectors, and the second mating section including a second plurality of electrical connectors configured to mate with the first plurality of electrical connectors upon overlapping engagement of the first mating section and the second mating section;

a first electrical cable positioned in the cable entrance of the first housing shell;

a second electrical cable positioned in the cable entrance section of the second housing shell;

a first chamber adjacent to the first cable entrance section;

a lip between the first chamber and the first cable entrance; and a first ball disposed in the chamber and having a diameter larger than a diameter of the lip, wherein the first electrical cable includes a plurality of conducting wires that pass around the outer surface of the ball.

26. The inline electrical connector of claim 25, wherein the first electrical cable includes a fiber and the ball includes a channel, and the fiber passes through the channel.

27. The inline electrical connector of claim 25, further comprising:

a second chamber adjacent to the second cable entrance section;

a lip between the second chamber and the second cable entrance; and a second ball having a channel and disposed in the second chamber and having a diameter larger than the diameter of the lip, wherein the second electrical cable includes a plurality of conducting wires that pass around the outer surface of the second ball and a fiber that passes through the channel of the ball.

28. The inline electrical connector of claim 25, further comprising:

a first outer tube surrounding the first electrical cable; and a second outer tube surrounding the second electrical cable, wherein the first outer tube also surrounds the cable entrance of the first housing shell and the second outer tube also surrounds the cable entrance of the second housing shell.

29. The inline electrical connector of claim 25, wherein the first mating section includes a pair of fingers and the second mating section includes a pair of notched regions configured to receive the pair of fingers.

30. The inline electrical connector of claim 25, wherein the outer shell defines an inner surface sized to prevent separation of the mated first and second housing shells.

31. The inline electrical connector of claim 25, wherein the first electrical cable comprises a first end and a second end and the first end is positioned in the cable entrance of the first housing shell and the second end is connected to a cardiac assist device.

32. The inline electrical connector of claim 31, wherein the second electrical cable comprises a first end and a second end and the first end is positioned in the cable entrance of the second housing shell and the second end is connected to a controller for the cardiac assist device.

33. The inline electrical connector of claim 31, wherein the second plurality of electrical connectors are oriented to receive the first plurality of electrical connectors upon overlapping engagement of the first mating section and the second mating section.

34. The inline electrical connector of claim 31, wherein the first housing shell includes a first snap ring, at least one o-ring and a pair of notched regions, and the second housing shell includes a second snap ring, at least one o-ring and a pair of fingers configured to be inserted into the pair of notched regions.

35. The inline electrical connector of claim 34, further comprising an outer shell that includes a pair of channels that encircle an inside circumference of the outer shell and are configured to retain the first and second snap rings, wherein the outer shell is configured to be placed around the mated first housing shell and the second housing shell when mated to form a compression fit between the o-rings and at least a portion of an inside circumference of the outer shell.

36. A method of forming an inline electrical connection, comprising:

providing a first connector structure having a plurality of pins disposed on a substantially planar first mating surface;

providing a second connector structure having a plurality of sockets disposed on a substantially planar second mating surface;

inserting the plurality of pins into the plurality of sockets upon overlapping engagement of the first mating section and the second mating section;

inserting a first cable into a first cable receptacle of the first connector structure;

inserting a second cable into a second cable receptacle of the second connector structure;

placing a first outer tube over the first cable and cable receptacle;

placing a second outer tube over the second cable and cable receptacle, wherein the outer tubes prevent fluid from entering the connector structures; and placing an outer shell around the overlapped first and second housing structures, wherein said outer shell further includes a channel on an inside circumference, which is configured to receive and form an interference fit with a snap ring placed on fluid barrier sections of said housing structures.

37. The method of claim 36, further comprising inserting a pair of interlocking fingers of the first connector structure into a pair of notched regions of the second connector structure upon mating of the first connector structure and the second connector structure.

38. The method of claim 32, further comprising inserting a plurality of lips on the first mating section into a plurality of grooves in the second mating section, wherein the plurality of lips surround at least a portion of each one of a first plurality of electrical connectors and the plurality of grooves surround at least a portion of each one of a second plurality of electrical connectors and each groove is configured to receive one lip to form an interference fit connection.

39. The method of claim 36, further comprising slidably positioning an outer shell over the mated first connector structure and second connector structure, wherein the outer shell includes a pair of channels encircling an inside circumference of the outer shell, each channel configured to retain a first snap ring on the first connector structure and a second snap ring on the second connector structure.

40. The method of claim 39 further comprising forming an interference fit between a portion of the inside circumference of the outer shell and a first o-ring on the first connector structure and a second o-ring on the second connector structure to prevent passage of fluids between the o-rings and inside circumference of the outer shell.

41. An electrical connector assembly comprising:

a first connector structure defining a first substantially planar connector surface;

a second connector structure defining a second substantially planar connector surface;

a plurality of first electrical connectors disposed within the first substantially planar surface, the first electrical connectors extending in a direction substantially perpendicular to the first substantially planar surface;

a plurality of second electrical connectors disposed within the second substantially planar surface, the second electrical connectors being oriented to engage the first electrical connectors upon overlapping engagement of the first connector structure and the second connector structure; and an outer shell configured to be placed around the first and the second connector structures upon overlapping engagement of the first and the second connector structures;

wherein:

the first connector structure includes a first fluid barrier section and the second connector structure includes a second fluid barrier section, the fluid barrier sections being configured to prevent the flow of fluids to the electrical connector, and at least one of the first connector structure and the second connector structure further includes a snap ring on one of the fluid barrier sections and the outer shell includes at least one channel on its inside circumference configured to receive and form an interference fit with the at least one snap ring to substantially prevent the outer shell from becoming dislodged upon overlapping engagement of the first connector structure and the second connector structure and placement of the outer shell about the first and the second connector structures.

42. The connector assembly of claim 41, further comprising:

a first cable receptacle formed in the first connector structure for receipt of a first cable having a plurality of first electrical conductors;

a second cable receptacle formed in the second connector structure for receipt of a second cable having a plurality of second electrical conductors;

a first inner region formed in the first cable receptacle, the first inner region configured for receipt and routing of the first electrical conductors to the first electrical connectors; and a second inner region formed in the second cable receptacle, the second inner region configured for receipt and routing of the second electrical conductors to the second electrical connectors.

43. The connector of claim 41, wherein the first connector structure further defines a semi-circular portion and the second connector structure further defines a semi-circular portion.

44. The connector of claim 41, wherein the first substantially planar connector surface includes at least two fingers and the second substantially planar connector surface includes at least two notched regions configured to receive the fingers.

45. The connector of claim 41, wherein the plurality of first electrical connectors are potted to the first substantially planar connector surface with epoxy and the plurality of second electrical connectors are potted to the second substantially planar connector surface with epoxy.

46. The connector of claim 41, wherein the plurality of first electrical connectors comprise conductive sockets and the plurality of second electrical connectors comprise conductive pins configured to be placed in the conductive sockets.

47. The connector of claim 41, wherein the plurality of first electrical connectors comprise pairs of conductive spring-biased blades and the plurality of second electrical connectors comprise conductive blades configured to be placed in the pairs of conductive spring-biased blades.

48. The connector of claim 41, further comprising:

a plurality of lips on the first connector structure; and a plurality of grooves on the second connector structure, wherein each groove is configured to receive a lip to form an interference fit connection and in which each connection is configured to be fluid resistant and resist separation of the first connector structure from the second connector structure.

49. The connector assembly of claim 41, further comprising a retention member that holds the first and second connector structures together.

50. The connector of claim 49, further comprising a first o-ring mounted in a first channel of the first connector structure and a second o-ring mounted in a second channel of the second connector structure, wherein the o-rings are configured to form compression fits with at least a portion of the retention member to substantially seal the connector surfaces against fluids upon overlapping engagement of the connector surfaces and placement of the retention member about the first and second connector structures.

51. The electrical connector assembly of claim 41, wherein the first connector structure includes a first cable entrance and the second connector structure includes a second cable entrance, the assembly further comprising:

a first electrical cable positioned in a first cable entrance section of the first connector structure;

a second electrical cable positioned in a second cable entrance section of the second connector structure;

a first chamber adjacent to the first cable entrance section;

a lip defined between the first chamber and the first cable entrance; and a first ball disposed in the chamber and having a diameter larger than a diameter of the lip; wherein the first electrical cable includes conducting wires that pass around the outer surface of the ball.

52. The electrical connector assembly of claim 51, wherein the first electrical cable includes a fiber and the ball includes a channel, through which the fiber passes.

53. The electrical connector assembly of claim 51, further comprising:

a second chamber adjacent to the second cable entrance section;

a lip between the second chamber and the second cable entrance; and a second ball disposed in the second chamber and having a channel and a diameter larger than the diameter of the lip, wherein the second electrical cable includes conducting wires that pass around the outer surface of the second ball and a fiber that passes through the channel of the second ball.

54. The electrical connector assembly of claim 51, further comprising:

a first outer tube surrounding the first electrical cable; and a second outer tube surrounding the second electrical cable, wherein the first outer tube also surrounds the cable entrance of the first housing shell and the second outer tube also surrounds the cable entrance of the second housing shell.

55. The electrical connector assembly of claim 41, wherein the other of the first connector structure and the second connector structure further includes a second snap ring on one of the fluid barrier sections and the outer shell includes a second channel on its inside surface configured to receive and form an interference fit with the second snap ring.

* * * * *

UNITED STATES PATENT AND TRADEMARK OFFICE

CERTIFICATE OF CORRECTION

PATENT NO. : 6,305,962 B1
DATED : October 23, 2001
INVENTOR(S) : Maher et al.

It is certified that error appears in the above-identified patent and that said Letters Patent is hereby corrected as shown below:

Column 17,
Line 17, please delete “32” and insert -- 37 -- therefor.

Signed and Sealed this

Twenty-seventh Day of August, 2002

*Attest:*

*Attesting Officer*

JAMES E. ROGAN
*Director of the United States Patent and Trademark Office*